US006102814A

United States Patent [19]

Grace et al.

[11] Patent Number: 6,102,814

[45] Date of Patent: Aug. 15, 2000

[54] GOLF PUTTER WITH AN UNDERCUT ON THE BACK FACE

[75] Inventors: Robert M. Grace, Clearwater; Harold Parker, Jr., St. Petersburg, both of Fla.; Robert S. Dubiel, Rancho Santa Fe, Calif.

[73] Assignee: Cobra Golf Incorporated, Carlsbad, Calif.

[21] Appl. No.: 09/118,620

[22] Filed: Jul. 17, 1998

[51] Int. Cl.[7] ..... A63B 53/04

[52] U.S. Cl. ..... 473/340; 473/341

[58] Field of Search ..... 473/340, 341, 473/313, 349; D21/739, 738, 737

[56] References Cited

U.S. PATENT DOCUMENTS

| | | | |
|---|---|---|---|
| D. 240,245 | 6/1976 | Aragona . | |
| D. 240,247 | 6/1976 | Richilano . | |
| D. 285,473 | 9/1986 | Flood . | |
| D. 314,031 | 1/1991 | Iiuma | D21/739 |
| D. 318,087 | 7/1991 | Helmstetter . | |
| D. 326,130 | 5/1992 | Chorne . | |
| D. 352,324 | 11/1994 | Sicaeros . | |
| D. 354,103 | 1/1995 | Allen . | |
| D. 357,290 | 4/1995 | Viollaz et al. . | |
| D. 360,009 | 7/1995 | Grace . | |
| D. 360,922 | 8/1995 | Grace . | |
| D. 371,180 | 6/1996 | Grace . | |
| D. 371,589 | 7/1996 | Fortini . | |
| D. 372,063 | 7/1996 | Hueber . | |
| D. 373,160 | 8/1996 | Grace . | |
| 1,671,956 | 5/1928 | Sime . | |
| 5,464,217 | 11/1995 | Shenohan et al. . | |
| 5,467,987 | 11/1995 | Perkins et al. . | |
| 5,467,988 | 11/1995 | Henwood . | |
| 5,484,155 | 1/1996 | Yamawaki et al. . | |
| 5,518,243 | 5/1996 | Redman . | |
| 5,676,606 | 10/1997 | Schaeffer et al. . | |
| 5,769,738 | 6/1998 | Kershaw et al. | 473/340 |

OTHER PUBLICATIONS

Photos of Lynx putterhead developed prior to 1998.

*Primary Examiner*—Kien T. Nguyen
*Attorney, Agent, or Firm*—Pennie & Edmonds LLP

[57] ABSTRACT

A putter head having a back face undercut is disclosed. The undercut is a section cut into the sole, thereby forming an undercut back face perpendicular to the sole and substantially parallel to the strike face. The undercut results in enhanced heel/toe weighting and an elevation of the center of gravity of the putter head. The undercut back face preferably includes a logo or other indicia that is visible when viewing the back face of the putter, but that is not visible when viewing the putter from above.

6 Claims, 6 Drawing Sheets

GOLF PUTTER WITH AN UNDERCUT ON THE BACK FACE

BACKGROUND OF THE INVENTION

1. Technical Field

The present invention relates generally to equipment used in the game of golf. More particularly, the present invention relates to an improved golf putter head with an undercut on the back face.

2. Discussion of the Related Art

Historically, golf putters have fallen into two categories of clubs—mallet-style and blade-style. The mallet-style putter has a relatively large, solid head that is often semi-circular in shape when viewed from above, while the blade-style putter has a relatively narrow or blade-like head. Each type of putter includes a generally flat strike face for hitting the golf ball, usually set at a 4° loft, and accuracy of the putt is dependent on where the strike face impacts the ball, as well as on the orientation of the strike face at impact. Accuracy also depends on hitting the ball at a central area of the strike face, known in the art as the "sweet spot". Generally, control of the direction of travel of the golf ball, and the distance travelled, decreases with the increase in distance away from the sweet spot from which the ball is struck. However, the effective hitting area or sweet spot may be expanded by appropriately weighting the putter head. Weighting may also be used to improve the feel and stability of the putter head during the putting stroke.

In recent years, golf club technology has evolved rapidly, with many different modifications having been made to the general structure of golf club heads, including putter heads. For example, golf club heads have been designed with back face undercuts having inserted weights, with holographic inserts on the trailing edge bevel, with cut-out sections extending through both the sole and crown of the club head, and with a strike face having two planar surfaces, one being offset from the other.

Golf club heads have also been designed with recessed back cavities. These recessed back cavities have, however, been incorporated into golf clubs referred to in the art as "woods". Putters have additionally been configured to include recessed back cavities. However, the recessed back cavities of these putters have had the disadvantage of altering the appearance of the putter head when viewed from above.

Thus, while numerous modifications have been made to golf club heads in recent years, there exists a need in the art for logos or other indicia to be practically, and prominently, displayed on the back face of a putter head, without altering the appearance of the putter head as viewed from above. There additionally exists a need in the art for a putter head with enhanced heel/toe weighting, an elevated center of gravity, and the ability to be custom weighted and custom dimensioned without altering the radius of the putter head when viewed from above.

SUMMARY OF THE INVENTION

It is therefore an object of the present invention to provide a golf putter having an undercut on the back face, thereby enhancing heel and toe weighting, elevating the center of gravity, allowing for putter customization, and permitting the visible inclusion of a logo or other indicia on the undercut back face. It is a further object of the present invention to provide such a back face undercut without altering the appearance of the putter head as viewed from above.

In accordance with the invention, the back face of a putter head is undercut so as to form an undercut back face. The undercut is a section cut into the sole of the putter head to enhance heel/toe weighting and redistribute material to raise the center of gravity. As such, the undercut back face may preferably include a logo or other indicia that is visible when viewing the back face of the putter, but that is not visible when viewing the putter from above.

BRIEF DESCRIPTION OF THE DRAWINGS

The features and advantages of the present invention will be better understood by reference to the following detailed description, which should be read in conjunction with the accompanying drawings in which.

DETAILED DESCRIPTION OF THE INVENTION

The following embodiment of the present invention will be described in the context of a mallet-style putter head having a back face undercut, although those skilled in the art will recognize that the disclosed methods and structures are usable with other golf clubs.

Figure 1:
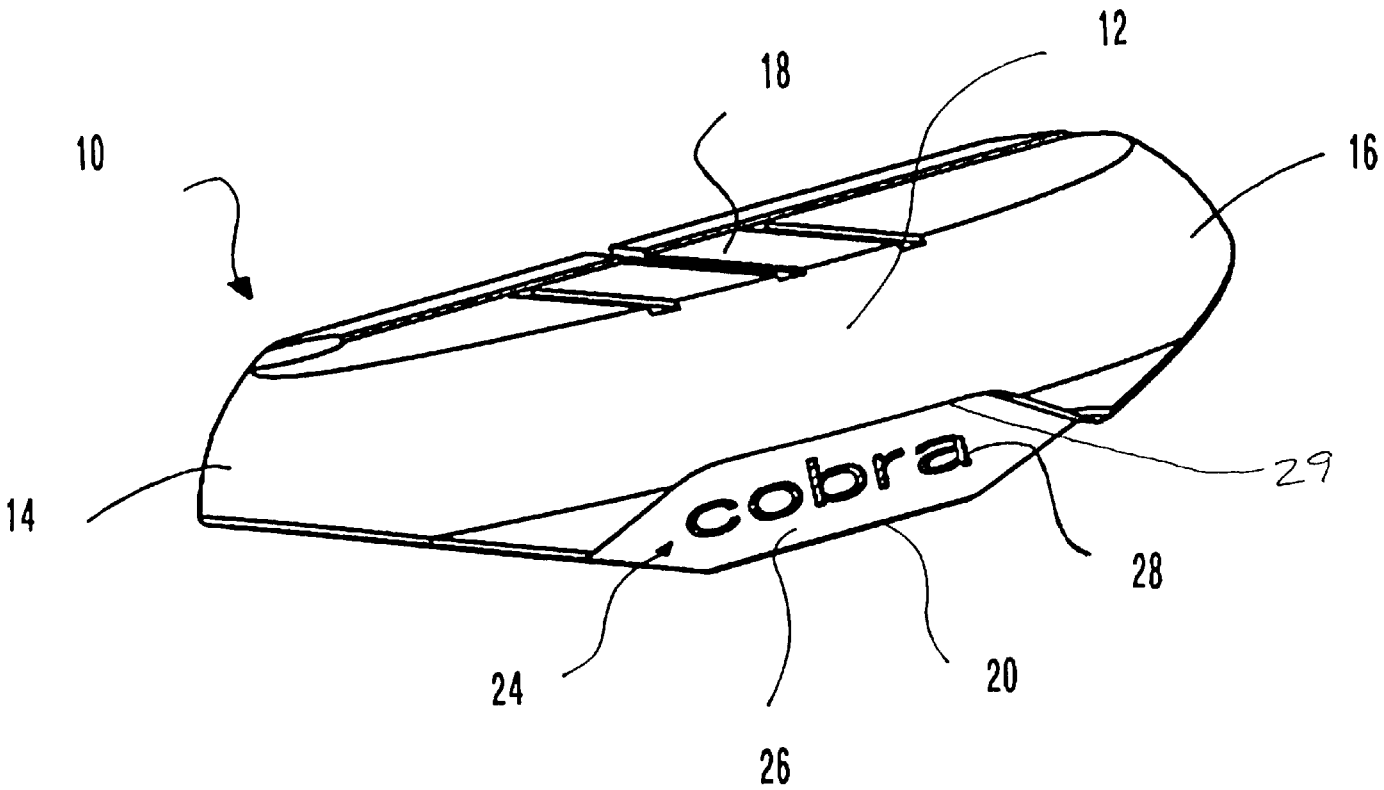
FIG. 1 is a rear perspective view of a golf club putter head having a back face undercut according to the invention.
Figure 2:
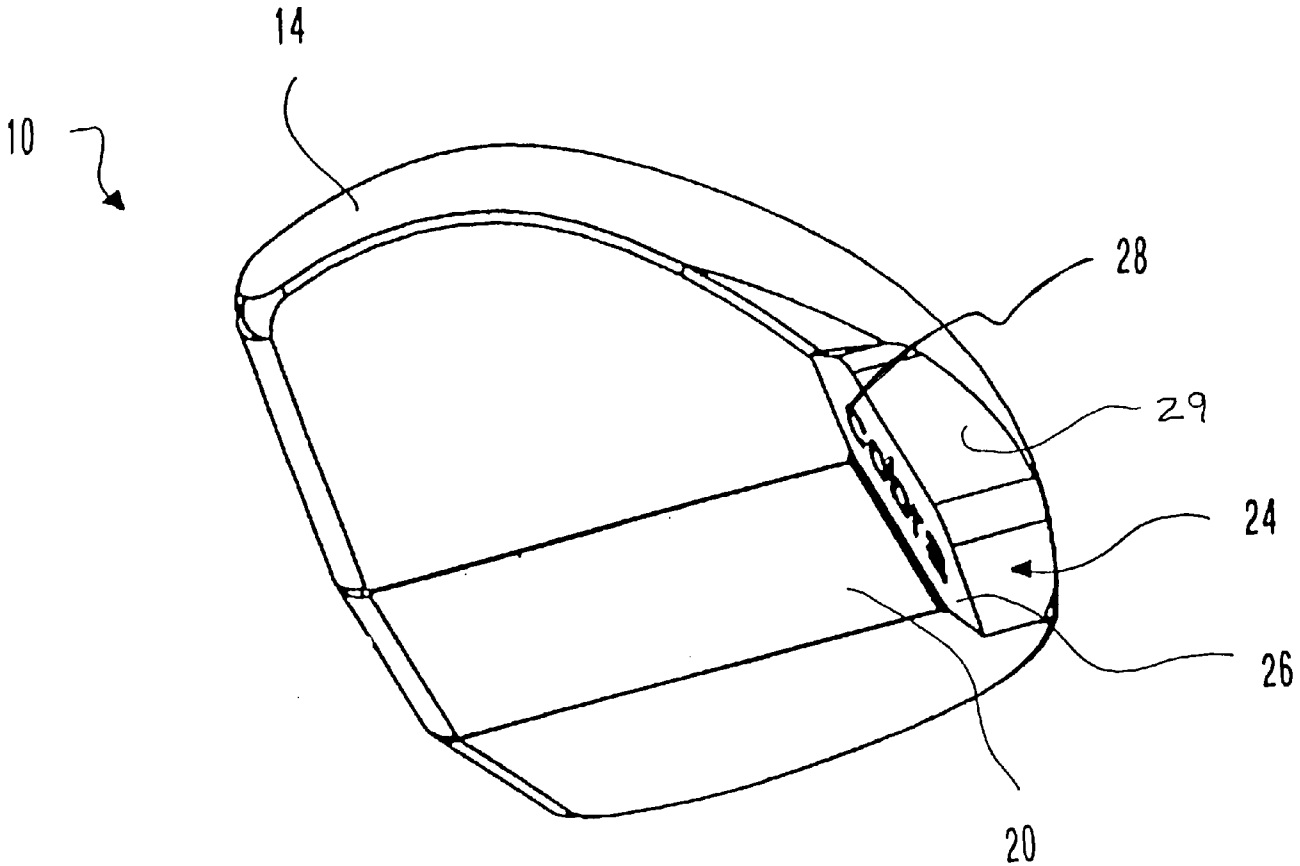
FIG. 2 is a bottom perspective view of the putter head of FIG. 1.
Figure 3:
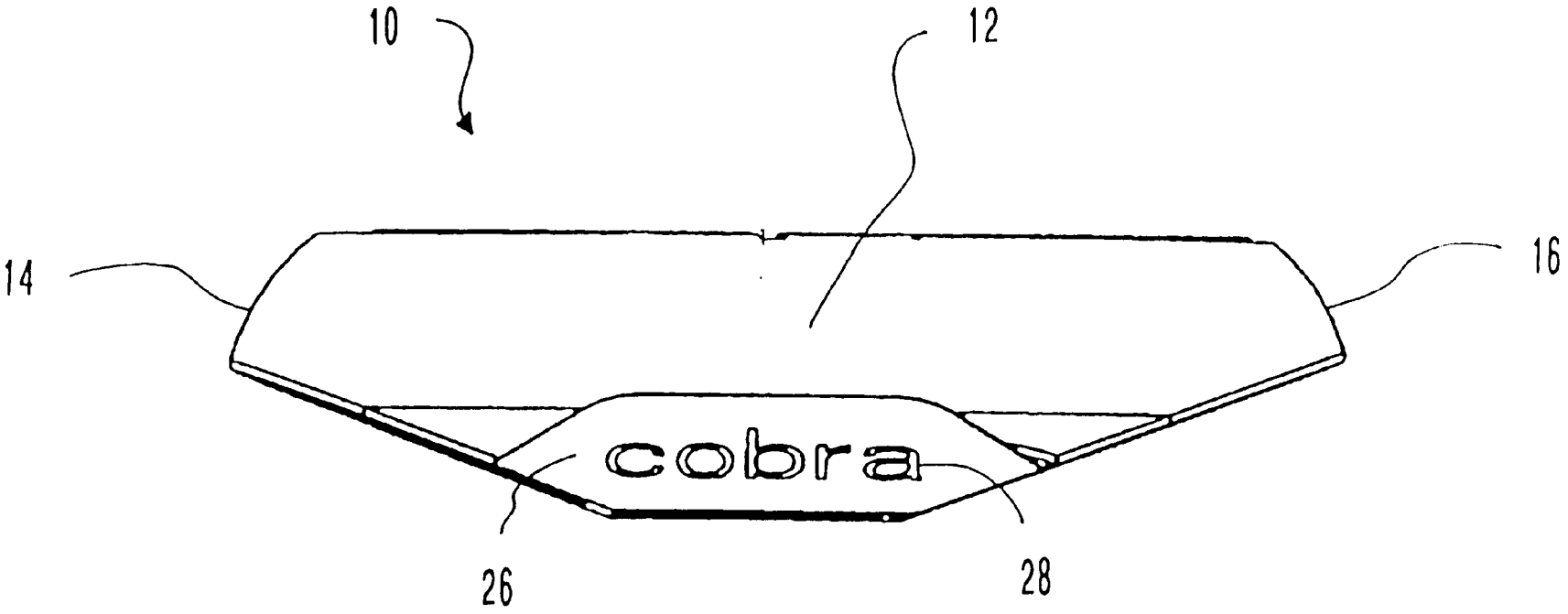
FIG. 3 is a rear view of the putter head of FIG. 1.
Figure 4:
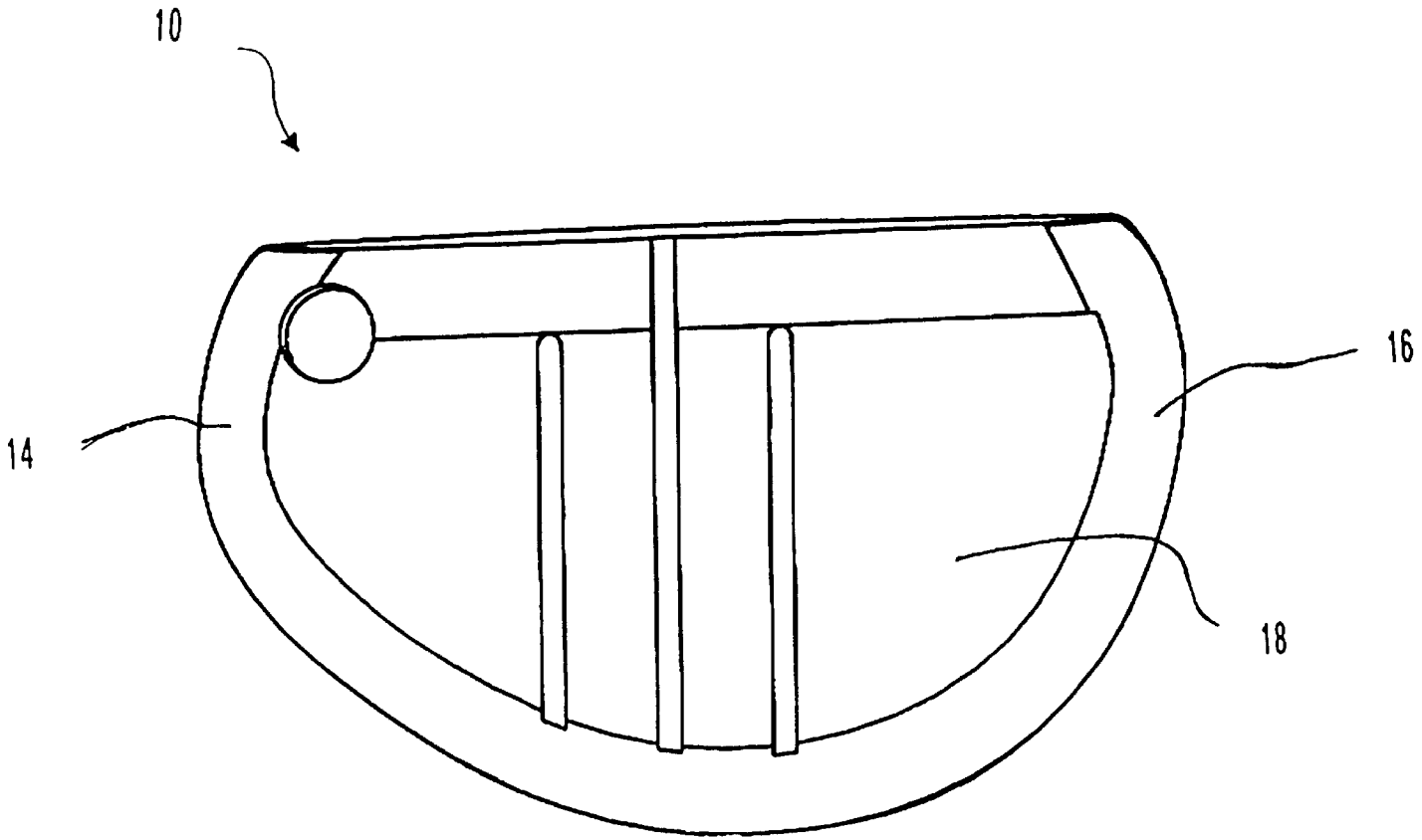
FIG. 4 is a top view of the putter head of FIG. 1.
Figure 5:
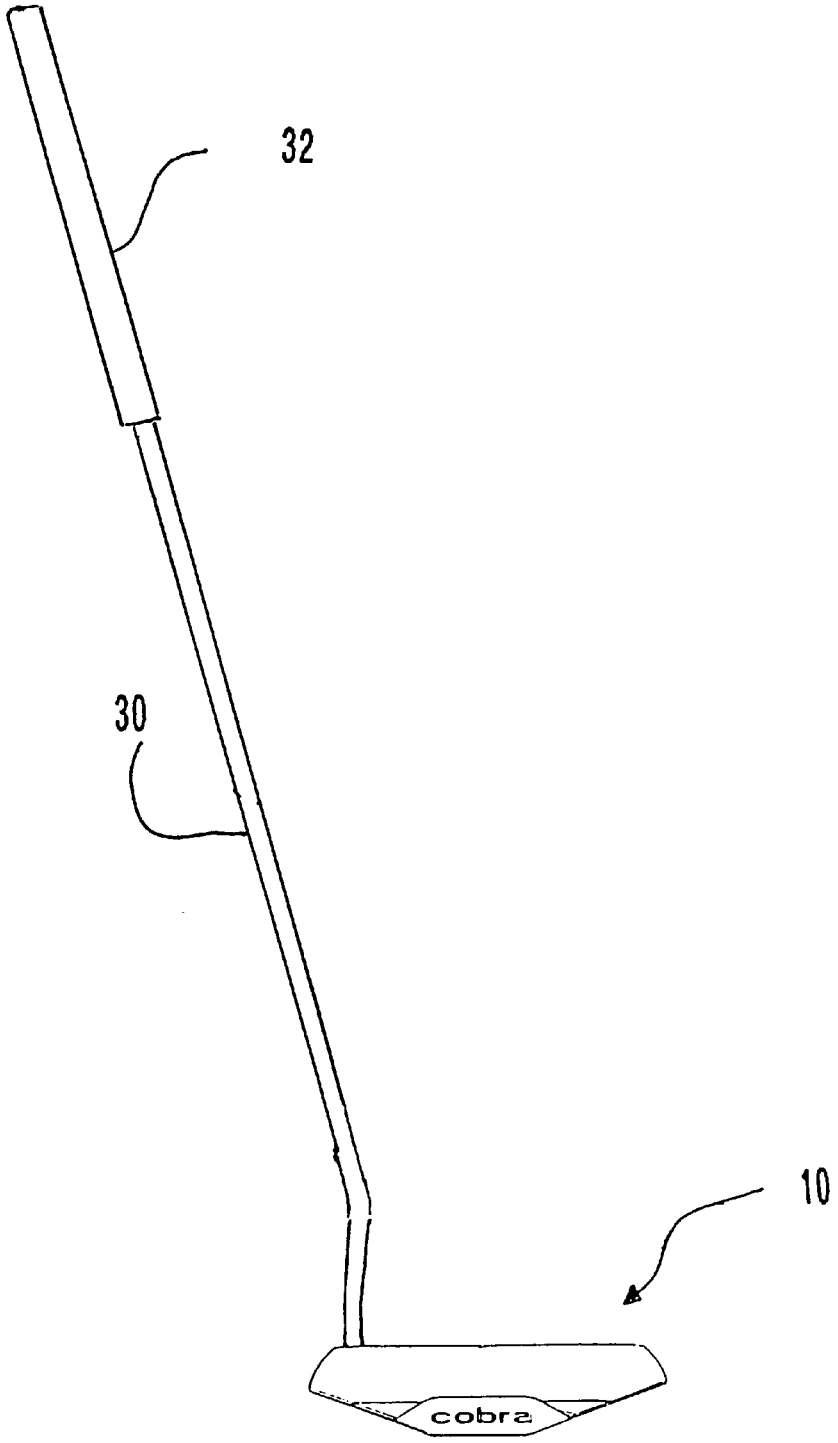
FIG. 5 is a rear view of a putter including the putter head of FIG. 1.

Referring now to FIGS. 1–6, each shows a mallet-style putter head 10 according to the invention. As shown in FIG. 1, putter head 10 includes a back face 12, a heel 14 and toe 16, a crown 18, a sole 20, and a front strike face (not visible). As shown in FIG. 5, putter head 10 may be affixed to a shaft 30 and putter grip 32. Although shaft 30 may be configured in any fashion, one suitable shaft is the UGGDBP-37 shaft manufactured by True Temper®.

In accordance with the teachings of the invention, back face 12 includes an undercut 24. Undercut 24 is not simply a bevel on the trailing edge of sole 20, but is instead a section cut into sole 20. This advantageously effects a flat, offset back face 26 (i.e., an undercut front wall) that is at least approximately perpendicular to the face of sole 20, substantially parallel to strike face 22 (although preferably not perfectly parallel given the 4° loft of strike face 22), and whereon a logo or other indicia 28 may be placed without altering the appearance of putter head 10 when viewed from above. The undercut also forms top wall 29 that is at least approximately parallel to the sole.

It will be appreciated that, although indicia 28 is formed to read "COBRA" (a registered trademark) in FIGS. 1–5, this indicia is merely illustrative. Indicia 28 may be a different set of characters or numbers, a logo, or any other indicia that is desired to appear prominently on back face 26. It will be additionally appreciated that, although back face 26 is configured in hexagonal fashion, as shown for example in FIG. 3, back face 26 may be configured in any size or shape without departing from the scope of the present invention. In this fashion, a novel golf putter head is provided that advantageously displays indicia on an undercut back face for the purpose of name or brand recognition in, for example, television advertising and retail golf shops, while at the same time preserving the soft radius of the mallet-style putter head as viewed from the golfer's perspective at address (top view).

Undercut 24 and resulting back face 26 are additionally advantageous as they generally improve weight distribution in the putter head, thereby increasing the effectiveness of the putter. More specifically, mass removed from back face 12 can be redistributed of back face 26, towards heel 14 and toe 16. Distribution of putter-head weight in this fashion helps stabilize the direction of the golf ball at impact by increasing the effective sweet spot of the putter.

Figure 6:
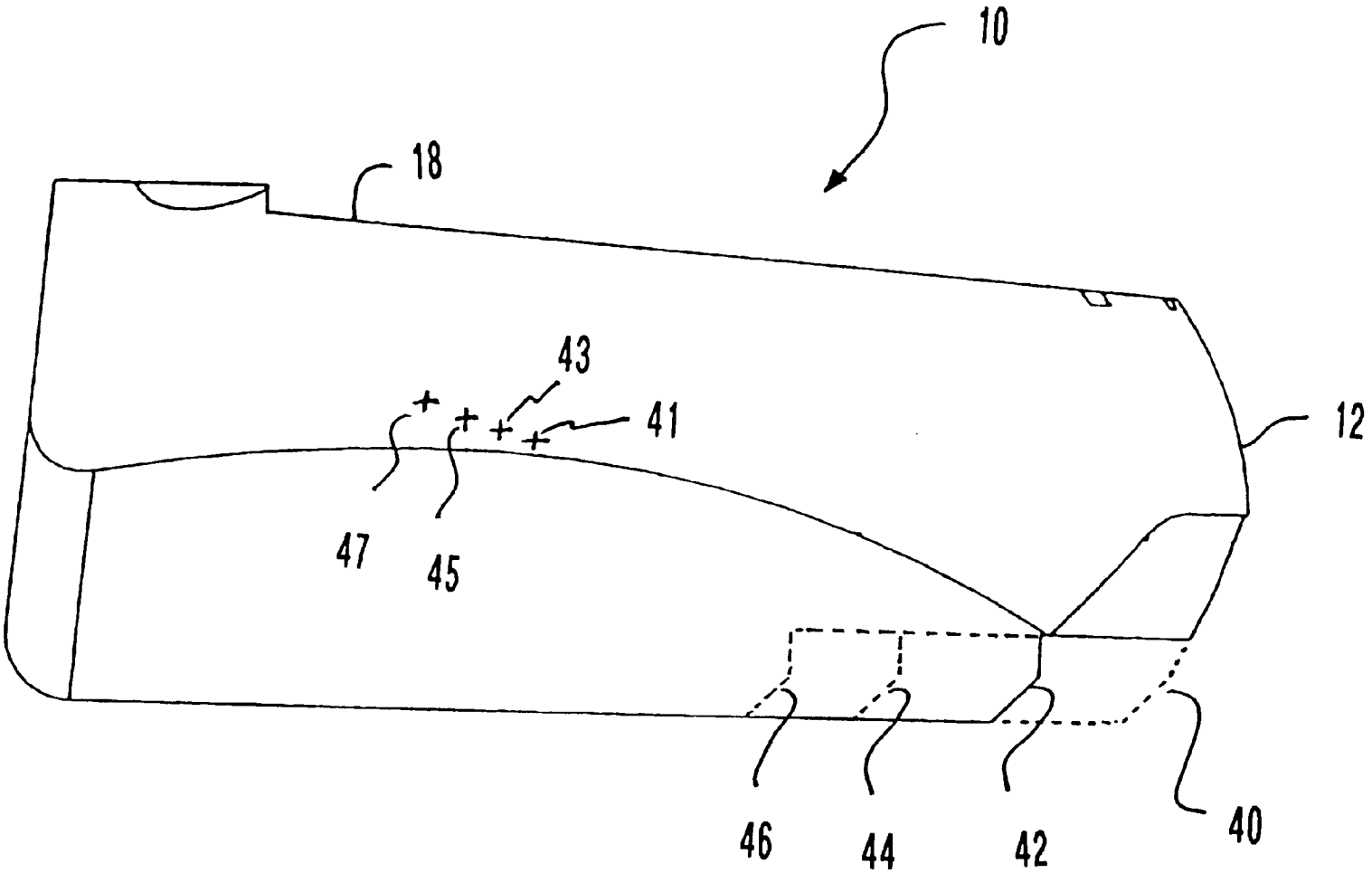
FIG. 6 is a side view of the putter head of FIG. 1, which illustrates the movement of the center of gravity of the putter head as the configuration of the back face undercut is selectively modified in accordance with the invention.

As shown in FIG. 6, undercut 24 also results in an advantageous elevation of the center of gravity of the putter head 10. More specifically, if putter head 10 included no undercut 24, as illustrated in FIG. 6 by dotted line 40, putter head 10 would possess an approximate center of gravity 41. If, however, the undercut disclosed in FIGS. 1–5 is included, as illustrated by solid line 42, an elevated and more forward, approximate center of gravity 43 results without compromising the look and soft radius of the putter head when viewed from the golfer's perspective. By elevating and moving forward the center of gravity in this fashion, hopping and skipping of the golf ball off strike face 22 is reduced, generally improving the roll of the ball off the putter head. Depending upon the particular tastes of an individual golfer, putter head 10 may be customized so as to further elevate, or if necessary lower, the center of gravity of putter head 10. So, for example, if the undercut of putter head 10 is deepened, as illustrated by dotted line 44, an additionally elevated center of gravity 45 will result. Similarly if the undercut of putter head 10 is deepened as illustrated by dotted line 46, a still further elevated center of gravity 47 may be obtained. Thus, in accordance with the invention, putter head 10 may be customized, using the configuration and dimensions of undercut 24, so as to elevate or lower the putter head center of gravity.

Undercut 24 additionally allows for an uncomplicated, novel means by which the putter head may be custom weighted. For example, as the length of shaft 30 (in combination with grip 32) of the putter shown in FIG. 5 is shortened, the swing weight of the putter will necessarily decrease if the weight of the putter head is kept constant. Conversely, as the length of shaft 30 is lengthened, the swing weight of the putter will necessarily increase if the weight of the putter head is kept constant. Accordingly, if a golfer would like his putter shaft increased from 34" to 35", for example, but desires that the swing weight of his putter remain constant, the weight of the putter head must be decreased. Similarly, the putter head weight must be reduced if a golfer would like to keep the same putter shaft length, but would like the swing weight of his putter reduced. In such instances, undercut 24 may be deepened in accordance with the invention, thereby reducing the weight of putter head 10 without impacting the look and soft radius of the putter head from the golfer's perspective. Similarly, if it is necessary or desired that the putter-head weight be increased (either to increase swing weight or keep the swing weight constant while shortening the putter shaft), undercut 24 may be dimensioned in a more shallow fashion, thereby increasing the weight of putter head 10, again without impacting the look and soft radius of the putter from the golfer's perspective.

Yet another example of how undercut 24 allows for an uncomplicated means by which the putter head may be custom weighted, is with respect to the putter "sweet spot". As previously mentioned, the effective hitting area or sweet spot of the putter may be expanded by appropriately weighting the putter head. More particularly, as the weight of the putter head is moved to the heel and toe, the effective sweet spot of the putter will increase in size. Such an increase of the putter's sweet spot can be beneficial to any golfer, but in particular to those golfers with high handicaps. Thus, in accordance with the invention, if a particular golfer, or a particular class of golfers such as seniors or women, desire a larger sweet spot, undercut 24 may be deepened. Deepening of undercut 24 allows for redistribution of the putter head weight towards heel 14 and toe 16, and an increase in the size of the putter sweet spot. Similarly if a particular golfer, or a particular class of golfers, desires a smaller putter sweet spot to improve feel, undercut 24 may be configured in a more shallow fashion to permit redistribution of the putter head weight towards the center of putter head 10, and a decrease in the size of the putter sweet spot.

Indeed, one skilled in the art will understand that, when customizing putter head 10, undercut 24 may be configured in as shallow (i.e., tenths of inches) or as deep (i.e., extending almost to the strike face) a fashion as is necessary to meet a particular golfer's individual desires.

Various embodiments of the invention have been described. The descriptions are offered by way of illustration, not limitation. Thus, it will be apparent to those skilled in the art that modifications may be made to the invention as described without departing from the scope of the claims set out below. So, for example, while the illustrative putter head of FIGS. 1–6 is shown as having a mallet-style, it is to be understood that other putter head shapes, including blade-style, may be utilized without departing from the scope of the present invention.

What is claimed is:

1. A golf putter head, comprising:

a body having a front strike face, a back face, a crown, a sole, a heel, a toe, and an undercut forming an undercut back face forward of at least a portion of said back face, rearward of said strike face, and at least approximately perpendicular to and extending upward from the sole, said undercut being inwardly recessed, disposed rearwardly of the front strike face and inwardly of the heel and toe such that said undercut is not visible when said putter head is viewed from above, wherein said undercut has a size and depth sufficient to redistribute putter head weight in the heel and toe and elevate the center of gravity of the putter head relative to the sole, and wherein said undercut has a size, depth and location sufficient to further redistribute the weight to move forward the center of gravity of the putter head.

2. A golf putter head, comprising:

a body having a front strike face, a back face, a crown, a sole, a heel, a toe, and an undercut forming an undercut back face forward of at least a portion of said back face, rearward of said strike face, and at least approximately perpendicular to and extending upward from the sole, said undercut being inwardly recessed, disposed rearwardly of the front strike face and inwardly of the heel and toe such that said undercut is not visible when said putter head is viewed from above, and wherein mass undercut from the back face is redistributed forward and outward of said undercut back face, towards the heel and toe which redistribution elevates the center of gravity of the putter head relative to the sole.

3. A golf putter head, comprising:

a body having a sole, a front strike face at an angle of approximately 90° or less to said sole, a back face, a heel and a toe, wherein said back face defines an undercut having a front wall at least approximately perpendicular to the sole and a top wall such that said back face as viewed from above maintains a profile without revealing said undercut, wherein indicia are disposed on said undercut front wall, said indicia being visible from a rear view but not a top view of said putter head, and wherein mass removed from the back face is redistributed outward of said back face, towards the heel and toe.

4. A golf putter, comprising:

a shaft;

a grip on a first end of said shaft;

a golf putter head on a second end of said shaft, said golf putter head including a body having a sole, a front strike face at least approximately perpendicular to said sole, a rounded back face, a heel and a toe, wherein said back face defines an undercut having a front wall at least substantially perpendicular to the face of the sole and a top wall such that said back face as viewed from above maintains a rounded profile without revealing said undercut, and wherein mass removed from the back face is redistributed forward and outward of said back face, towards the heel and toe.

5. A method of making a golf putter head, comprising the steps of:

forming a putter head body having a front strike face, a back face, a crown, a sole, a heel, and a toe, undercutting the back face to form an undercut back face substantially perpendicular to the sole, generally forward of said back face, and rearward of said strike face, said back face undercut being recessed inwardly of the body, rearwardly of the front strike face, and inwardly of the heel and toe such that said undercut is not visible when said putter head is viewed from above, wherein mass undercut from the back face is redistributed outward of said undercut back face, towards the heel and toe which redistribution elevates the center of gravity of the putter head relative to the sole.

6. A method of configuring and dimensioning a golf putter in accordance with a golfer's individual preferences, comprising the steps of:

determining a golfer's preferred putter head weight, center of gravity, and sweet spot size;

forming a putter head body having a front strike face, a back face, a crown, a sole, a heel, and a toe, undercutting the back face to form an undercut back face substantially perpendicular to the sole, wherein mass undercut from the back face is redistributed outward of said undercut back face, towards the heel and toe and wherein said back face undercut is generally forward of said back face, and rearward of said strike face, said back face undercut being recessed inwardly of the body, rearwardly of the front strike face, and inwardly of the heel and toe such that the undercut is not visible when said putter head is viewed from above, and having a size and depth sufficient to result in the golfer's preferred putter head weight, center of gravity, and sweet spot size.

* * * * *